US008776776B2

(12) United States Patent
Todd et al.

(10) Patent No.: US 8,776,776 B2
(45) Date of Patent: Jul. 15, 2014

(54) BAKING SYSTEM FOR A GAS COOKING APPLIANCE

(75) Inventors: Justin Patrick Todd, Louisville, KY (US); Daniel Joseph Trice, Louisville, KY (US); Timothy Andrew Gillespie, Louisville, KY (US); James Tomaszewski, Louisville, KY (US)

(73) Assignee: General Electric Company, Schenectady, NY (US)

( * ) Notice: Subject to any disclaimer, the term of this patent is extended or adjusted under 35 U.S.C. 154(b) by 699 days.

(21) Appl. No.: 13/008,310

(22) Filed: Jan. 18, 2011

(65) Prior Publication Data

US 2011/0108017 A1 May 12, 2011

Related U.S. Application Data

(63) Continuation-in-part of application No. 12/603,256, filed on Oct. 21, 2009.

(51) Int. Cl.
*F24C 3/08* (2006.01)
*F24C 3/12* (2006.01)

(52) U.S. Cl.
CPC ..... *F24C 3/128* (2013.01)
USPC ..... 126/39 R; 126/19 R; 126/273 R

(58) Field of Classification Search
USPC ..... 126/39 R, 19 R, 273 R; 219/395
See application file for complete search history.

(56) References Cited

U.S. PATENT DOCUMENTS

| | | | | |
|---|---|---|---|---|
| 3,405,747 | A | 10/1968 | Dennison | |
| 3,692,239 | A | 9/1972 | Genbauffe | |
| 4,240,397 | A * | 12/1980 | Seidel | 126/21 R |
| 4,915,613 | A | 4/1990 | Landis et al. | |
| 6,570,136 | B1 | 5/2003 | Lockwood et al. | |
| 6,734,403 | B2 | 5/2004 | Baker et al. | |
| 7,759,617 | B2 | 7/2010 | Bowles et al. | |
| 2003/0037780 | A1 | 2/2003 | Wiersma et al. | |
| 2008/0237212 | A1 | 10/2008 | Blackson et al. | |

* cited by examiner

*Primary Examiner* — Alfred Basichas
(74) *Attorney, Agent, or Firm* — Global Patent Operation; Douglas D. Zhang

(57) ABSTRACT

A gas cooking appliance includes a gas oven cavity for cooking a food item, the gas oven cavity including a top surface and a bottom surface, a lower heat source disposed adjacent the bottom surface of the gas oven cavity, an upper heat source disposed adjacent the top surface of the gas oven cavity, and a controller configured to cycle the upper heat source and the lower heat source for providing heat above and below the food item during cooking, wherein a cycle of the upper heat source is time-dependent, and a cycle of the lower heat source is temperature-dependent.

20 Claims, 5 Drawing Sheets

BAKING SYSTEM FOR A GAS COOKING APPLIANCE

CROSS-REFERENCE TO RELATED APPLICATIONS

This application is a continuation-in-part application of U.S. patent application Ser. No. 12/603,256, filed on Oct. 21, 2009, the disclosure of which is incorporated herein by reference in its entirety.

BACKGROUND OF THE INVENTION

The present disclosure relates generally to cooking appliances, and in particular to controlling a bake cooking cycle in an oven cavity of a gas cooking appliance.

Generally, cooking appliances such as gas ranges, cycle a single heat source during a bake cooking cycle within an oven cavity of the cooking appliance. This single heat source is generally positioned at a bottom of the oven cavity and beneath the items being baked. The cycling of a single heat source located beneath the items may result in uneven cooking. For example, since the heat source is located beneath the items, the bottom of the items may be seared or browned while the top(s) of the items remain substantially free from browning.

In a typical gas oven appliance, an electronic ignition system is used to ignite the gas supply of the oven. As will be understood in the art, a hot surface or "glow bar" type oven igniter or system is commonly used to ignite the gas supply in the oven. In these types of systems, the oven igniter and gas valve circuit are connected in series. As power flows through the oven igniter, the igniter heats up. When the oven igniter reaches a predetermined ignition temperature, the oven gas valve will open, allowing gas to flow from the burner. The glowing hot oven igniter will ignite the gas flow.

However, if the supply power or voltage to the oven igniter varies or fluctuates, as is common with household electric power supplies, the time required for the oven igniter to reach the predetermined ignition temperature can also fluctuate. In a typical situation, it can take on average between 30 to 90 seconds for the oven igniter to reach the predetermined ignition temperature and open the gas valve and ignite the gas at the oven burner. However, in the case of a drop in the supply voltage or power, the time required for the oven igniter to reach the predetermined ignition temperature can increase.

Certain gas oven cooking algorithms typically rely upon timed ON and OFF cooking algorithms, commonly referred to as bake and broil cycles. However, these timed cooking algorithms are susceptible to inconsistent cooking performance due to the variable input voltages to the ignition system in a gas powered range. If the time needed for the oven igniter to reach the predetermined ignition temperature is longer than anticipated by the timed cooking cycle, the actual cooking time may be adversely impacted.

As an example, an average time for a typical oven igniter to reach the predetermined ignition temperature at a nominal input power supply voltage of 120 VAC, can be in the range of approximately 30-90 seconds. One example of such an oven igniter is the Oven GlowBar Part Number 223C3381 manufactured by Saint-Gobain Igniter Products of Milford, N.H. (formerly Norton Igniter Products). However, if the input power supply voltage drops, to for example approximately 102 volts, the oven igniter will take a longer time to heat up and open the gas valve than it would at the nominal voltage. Thus, variations in the input voltage can result in variable oven flame ignition times, which directly affects consistency and quality of cooking performance. As noted above, if the input voltage to the glow bar oven igniter is lower than the nominal rated value, the period of time is required for the glow bar igniter to heat up and open the gas valve can be longer than the burner ON time. This can result in little or no heat being supplied during normal operating conditions and a rapid recovery cooking algorithm will be relied upon to maintain the oven cavity temperature. The term "rapid recovery" generally refers to a cooking algorithm that is used to increase the oven temperature back to the set point when the temperature of the oven cavity falls below a predetermined amount below the set point and normal cooking operation is not able to stabilize the temperature. This results in generally poor cooking performance. It would be advantageous to be able to utilize multiple heat sources for a cooking algorithm in a gas oven cavity that reduces input voltage susceptibility and enables more consistent cooking performance and food browning to address the problems identified above.

BRIEF DESCRIPTION OF THE INVENTION

As described herein, the exemplary embodiments overcome one or more of the above or other disadvantages known in the art.

One aspect of the exemplary embodiments relates to a gas cooking appliance. In one embodiment, the gas cooking appliance includes a gas oven cavity for cooking a food item, the gas oven cavity including a top surface and a bottom surface, a lower heat source disposed adjacent the bottom surface of the gas oven cavity, an upper heat source disposed adjacent the top surface of the gas oven cavity, and a controller configured to cycle the upper heat source and the lower heat source for providing heat above and below the food item during baking, wherein a cycle of the upper heat source is time-dependent, and a cycle of the lower heat source is temperature-dependent.

Another aspect of the disclosed embodiments relates to a method of controlling a cooking cycle in a gas cooking appliance having a lower heat source disposed adjacent to a bottom surface of a gas oven cavity for providing heat below a food item and an upper heat source disposed adjacent to a top surface of a gas oven cavity for providing heat above a food item. In one embodiment, the method includes activating the upper heat source for a first predetermined period of time, deactivating the upper heat source at a start of a second predetermined period of time, activating the lower heat source at an end of the second predetermined period of time, and deactivating the lower heat source when a temperature within the oven cavity reaches a maximum temperature set point.

These as other aspects and advantages of the exemplary embodiments will become apparent from the following detailed description considered in conjunction with the accompanying drawings. It is to be understood, however, that the drawings are designed solely for the purposes of illustration and not as a definition of the limits of the invention, for which reference should be made to the appended claims. Moreover, the drawings are not necessarily to scale and, unless otherwise indicated, they are merely intended to conceptually illustrate the structures and procedures described herein. In addition, any suitable size, shape or type of elements or materials could be used.

DETAILED DESCRIPTION OF THE EXEMPLARY EMBODIMENTS OF THE INVENTION

Figure 1:
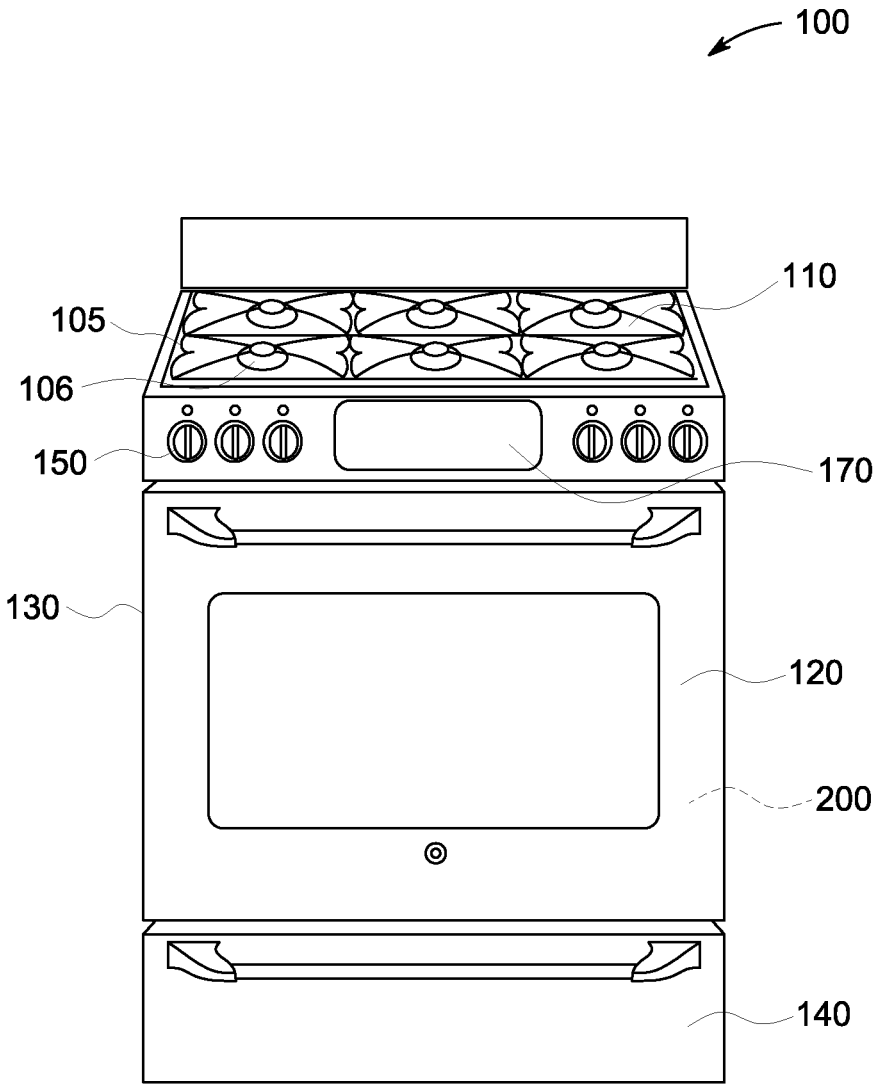
FIG. 1 is a schematic illustration of an exemplary gas cooking appliance incorporating aspects of the disclosed embodiments.

In one exemplary embodiment, referring to FIG. 1 a cooking appliance 100 is provided. The cooking appliance 100 may be any suitable cooking appliance, including but not limited to gas cooking appliances. In the examples described herein, the cooking appliance 100 is configured as a free standing range. However, it should be understood that while the embodiments of the invention are described herein with respect to a free standing range, the aspects of the disclosed embodiments may be applied to any suitable cooking appliance with or without a cooktop such as, for example, a wall oven unit.

In one embodiment, the cooking appliance 100 of FIG. 1 is a gas operated cooking appliance having an oven 120. The oven 120 of FIG. 1 includes a gas oven cavity 200 having first and second heat sources. The first and second heat sources are configured to be cycled (e.g. selectively turned on and off) for providing heat both above and below cooking items, such as food, being cooked within the gas oven cavity 200. In particular, as will be described herein, the aspects of the disclosed embodiments provide a cooking cycle that adds heat above the cooking item for a predetermined time period followed by a temperature dependent cycle of heat below the cooking item.

As illustrated in FIG. 1, the cooking appliance 100 includes a frame or housing 130. Internal cavities are formed within the housing 130, such as the gas oven cavity 200 of the oven 120, and/or drawer/mini-oven 140 for storing/baking items. The cooktop 110 includes one or more cooking grates 105 and respective burners 106 that are controlled in any suitable manner. In one example, each of the burners 106 may be controlled by a respective control knob 150 that is configured to regulate, for example, an amount of fuel provided to the respective burner. The cooking appliance 100 may also include a control unit 170 for controlling the heat sources within the gas oven cavity 200. The control unit or controller 170 may be suitably configured to control baking, broiling, cleaning, or other operations of the oven 120.

Figure 2:
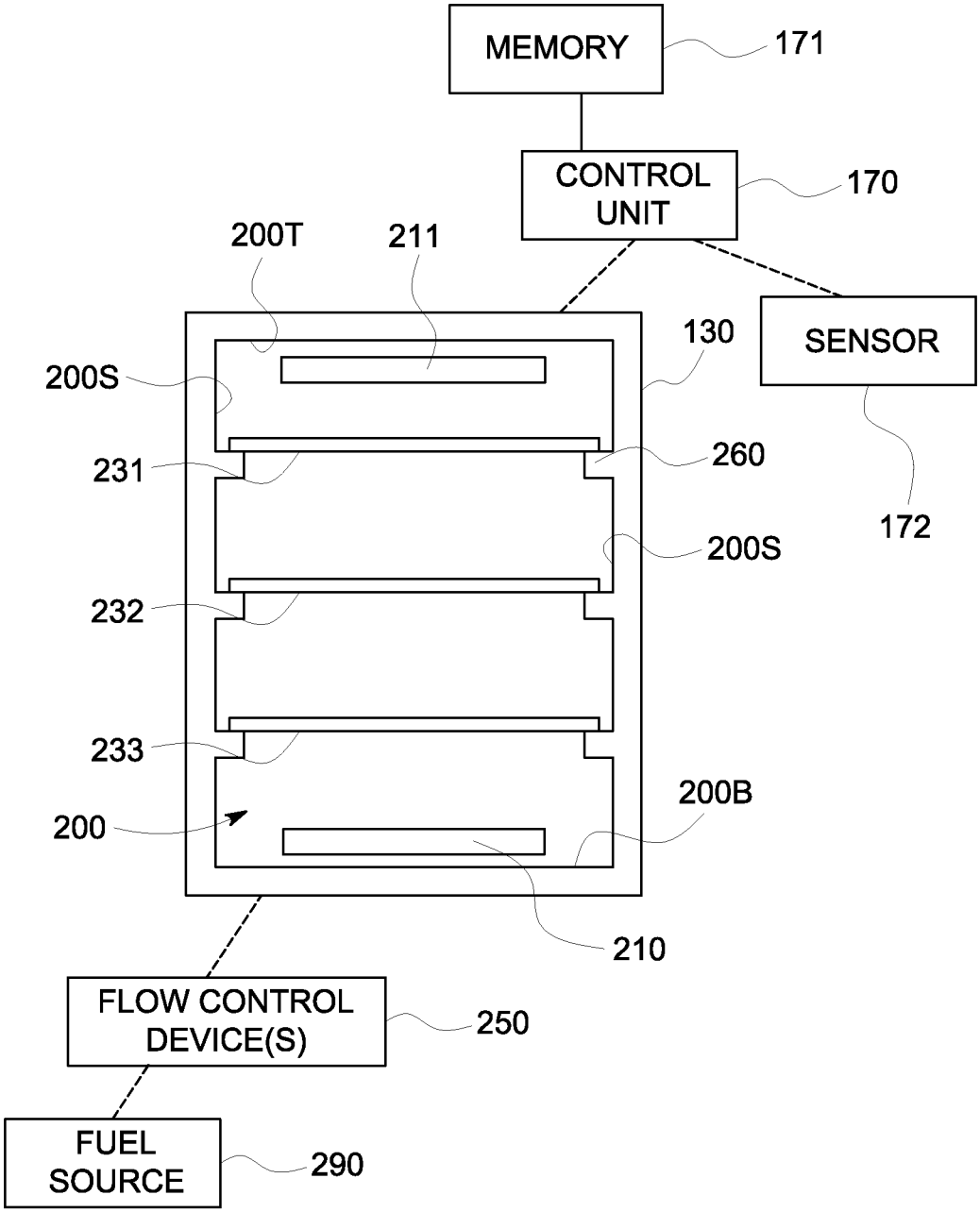
FIG. 2 is a schematic illustration of a portion of the appliance of FIG. 1 in accordance with an exemplary embodiment.

Referring to FIG. 2, the gas oven cavity 200 of the oven 120 includes side surfaces 200S, a top surface 200T and a bottom surface 200B. The side surfaces 200S may include one or more sets of protrusions 260 or other suitable support members. The protrusions 260 are configured so that oven racks 231-233 may be placed on the protrusions 260 for supporting items within the gas oven cavity 200 during, for example, a bake cooking cycle or baking. A first or lower heat source 210 is disposed within the gas oven cavity 200 adjacent the bottom surface 200B. For purposes of the description herein, the first or lower heat source 210 will be referred to as the "bake burner". A second or upper heat source 211 is disposed within the gas oven cavity 200 adjacent the top surface 200T. For purposes of the description herein, the second or upper heat source 211 will be referred to as the "broil burner". In one aspect of the exemplary embodiments, the first and second heat sources 210, 211 are gas burners. In other aspects of the exemplary embodiments an electrically powered heat source such as an electric heating element, conventional resistance heaters, ceramic or halogen type radiant heaters, or other suitable electrically powered heat source(s) may be disposed adjacent the top surface 200T in addition to or in lieu of the gas burner 211. In still other aspects of the exemplary embodiments, one or more of the first and the second heat sources may be, for example, an electric heating element or a gas heating element such as a gas infra-red burner, radiant gas or ceramic burner.

In this example, the first and second gas burners 210, 211 are of conventional design and obtain fuel from a suitable fuel supply or source 290. In one aspect of the exemplary embodiments, the control unit 170 is configured to control an amount of fuel provided by the fuel source 290 to a respective one of the first and second gas burners 210, 211. For example, the control unit 170 may control one or more valves, solenoids, or other flow control devices 250 for adjusting an amount of fuel provided by the fuel source 290 to each of the first and second heat sources 210, 211. In other examples, the control unit 170 may be configured to control one or more variable resistive devices (in addition to at least one gas burner) where the gas oven cavity 200 includes electrically powered heat source for controlling the output power of the electrically powered heat source.

During a bake cooking cycle or baking, the control unit 170 controls the selective cycling of the upper and lower heat sources 210, 211 ON and OFF as is further described herein. In this manner, the tops and bottoms of the items being baked (e.g. located on the racks 231-233) are substantially evenly browned or cooked. According to aspects of the disclosed embodiments, controller 170 selectively cycles the upper and lower heat sources 210, 211, generally referred to herein as "bake" and "broil" burner, respectively, so that during a baking cycle the broil burner 211 first adds top heat for a first predetermined period of time. The bake burner 210 then adds lower heat to achieve and maintain a set temperature of the oven cavity 200. As will be generally understood, in one embodiment, a bake cooking cycle can also include a preheat cycle. The preheat cycle will generally include a period of time during which the bake burner 210 is continuously on. This period of time will generally vary in the range of approximately 8 minutes to 20 minutes. Once a pre-determined temperature set point is reached, the bake cooking cycle can switch to the cooking cycle or algorithm described herein.

Figure 3:
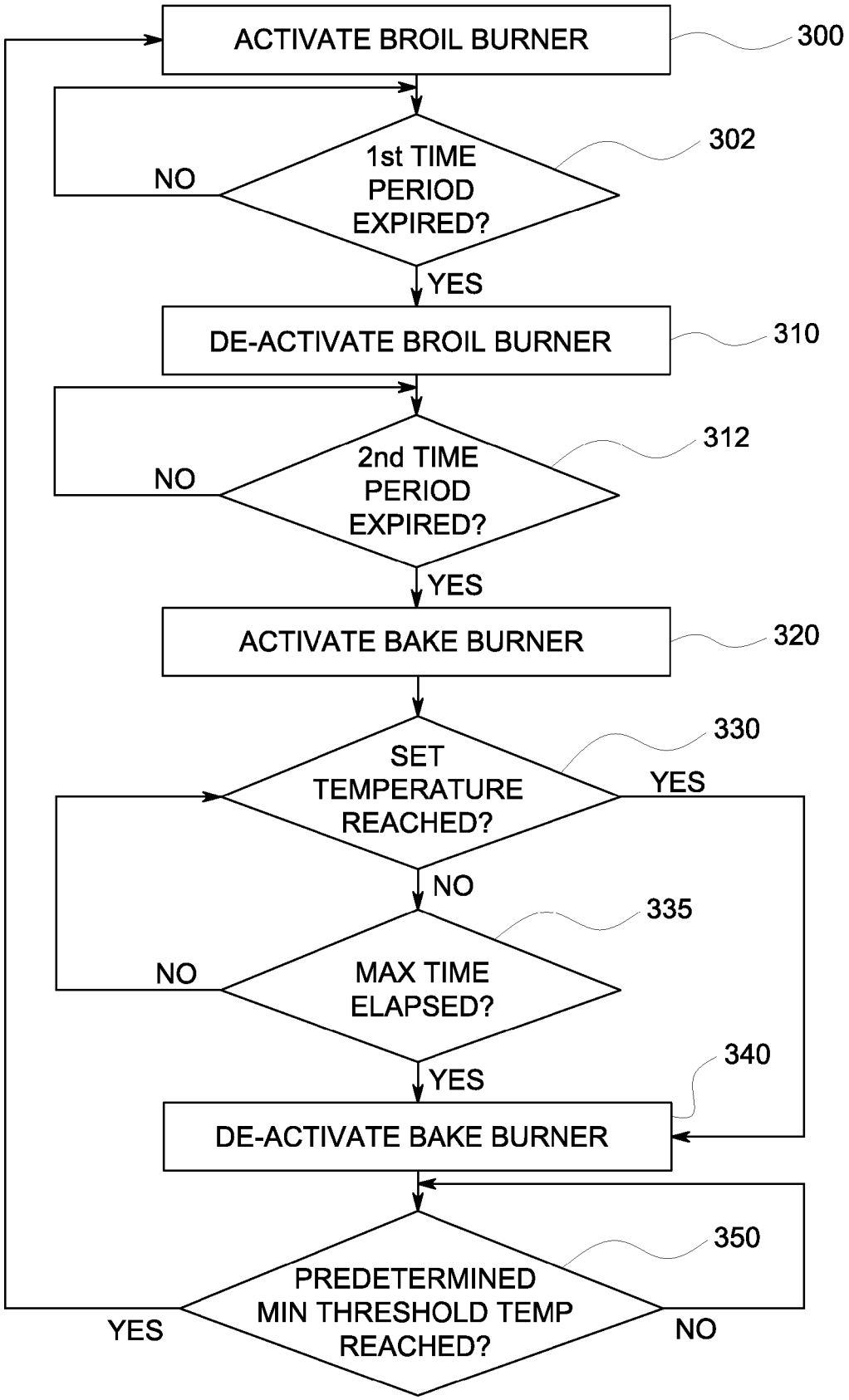
FIG. 3 is an exemplary flow diagram illustrating aspects of the disclosed embodiments.

Referring to FIG. 3, an exemplary cooking algorithm incorporating the selective cooking cycle of the disclosed embodiments will be described. In one embodiment, during a typical cooking cycle, referred to herein as a bake cycle, the second heat source or broil burner 211 is cycled on or activated 300 for a first predetermined time period 302. For purposes of the description herein, the timed cycle of the broil burner 211 will be referred to as a "timed broil cycle". The timed broil cycle is generally intended to achieve some browning on the top of the food in the oven cavity 200. After expiration of the first predetermined time period 302, the broil burner 211 is cycled off or deactivated 310 for a second predetermined time period 312. The second predetermined time period 312, which in one embodiment is approximately one (1) second, is to generally ensure that the lower heat source 210 and the upper heat source 211 are not activated at the same time.

At the expiration of the second predetermined time period, the lower heat source or bake burner 210 is cycled on or activated 320 for a temperature-dependent period or cycle. For the purposes of the description herein, the temperature-dependent cycle of the first heat source 210 is referred to as a "temperature-dependent bake cycle." The bake burner 210 will remain activated until a set or threshold temperature has been reached 330. After the set temperature is reached 330, the bake burner 210 can be turned off or deactivated 340. Both burners then remain off until it is determined 350 that the temperature in the oven falls below a predetermined minimum threshold temperature at which time the cycle repeats beginning with the cycling on of the upper heat source for another first predetermined time period. In one embodiment, the bake burner 210 may also be deactivated if the set or threshold temperature is not reached 335 within a predetermined period of time. For example, in one embodiment, a maximum time period that the bake cycle 320 can be active is approximately 254 seconds. Further embodiments of the timed broil cycle 300 and temperature dependent bake cycle 320 will be described in more detail in regards to FIGS. 4 and 5.

Figure 4:
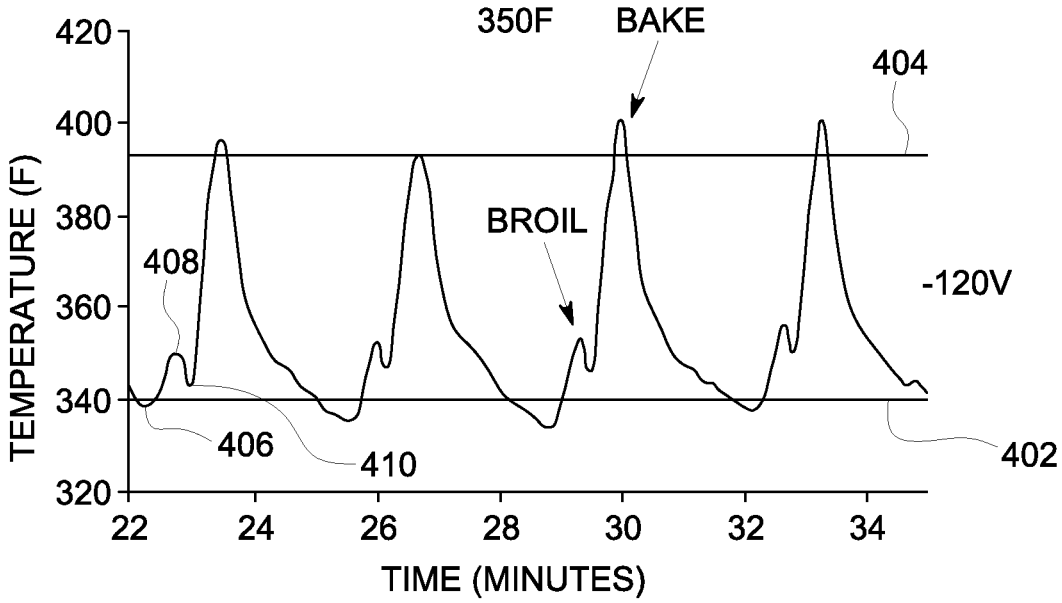
FIG. 4 is a graph illustrating cooking mode temperature fluctuations in an appliance incorporating aspects of the disclosed embodiments.

The graph in FIG. 4 generally provides an indication of the temperature variations during a cooking cycle in a cooking appliance 100 incorporating aspects of the disclosed embodiments. In this example, the oven set temperature is approximately 350 degrees Fahrenheit, as typically set by a user using one of the control knobs 150. As is shown in FIG. 4, selection of a bake temperature of 350 degrees Fahrenheit, in this embodiment establishes a minimum temperature set point or threshold 402 of approximately 340 degrees Fahrenheit, and a maximum temperature set point or threshold 404 of approximately 395 degrees Fahrenheit. The temperature inside the oven cavity 200 will fluctuate between the min 402 and max 404 temperature thresholds during the cooking cycle. In alternate embodiments, the minimum and maximum temperature set points associated with the selected bake temperature can be any suitable temperatures in order to maintain a desired temperature setting.

As is shown in FIG. 4, at a point 406, which in this example is approximately 22 minutes in the cooking cycle, the temperature inside the oven cavity 200 is at or falls slightly below the minimum temperature set point 402, as a result of the heat sources being cycled off due to the temperature previously having been raised above the maximum temperature set point. With reference again to FIG. 3, when the minimum temperature set point 402 is reached at point 406, the broil burner 211 is activated 300 for the first predetermined time period 302 which, in this example, is approximately 30 seconds. While the broil burner 211 is activated, top browning is achieved while the temperature inside the oven cavity 200 rises slightly, which in this example is approximately 15 degrees Fahrenheit. At the end of the 30 seconds, referenced by point 408, the broil burner 211 is then cycled off 310 for the second predetermined time period, which in this example is 15 seconds. As shown in FIG. 4, the temperature of the oven cavity 200 decreases slightly during the second time period, which in this example is approximately 5 degrees Fahrenheit. The temperature changes mentioned herein are merely exemplary, and can vary in different situations.

After both the ON and OFF cycles of the broiler burner 211 are complete, at point 410 on the graph of FIG. 4, the bake burner 210 will be activated 320 and remain ON until the temperature inside the oven cavity 200 reaches maximum temperature set point 404. Generally, the maximum temperature set point 404 is the temperature to which the oven cavity 200 should be heated in order to maintain an oven set temperature, which, in the example of FIG. 4, is approximately 350 degrees Fahrenheit. As is shown in the graph of FIG. 4, there will be a tendency for some overshoot of the minimum and maximum temperature set points 402, 404. Thus, for a desired oven cavity or cooking temperature of approximately 350 degrees Fahrenheit, the temperature swing between heating or cooking cycles in this example ranges from a low of approximately 335 degrees Fahrenheit to approximately 400 degrees Fahrenheit, where the minimum and maximum temperature set point values are approximately 340 and 395 degrees Fahrenheit, respectively.

Figure 5:
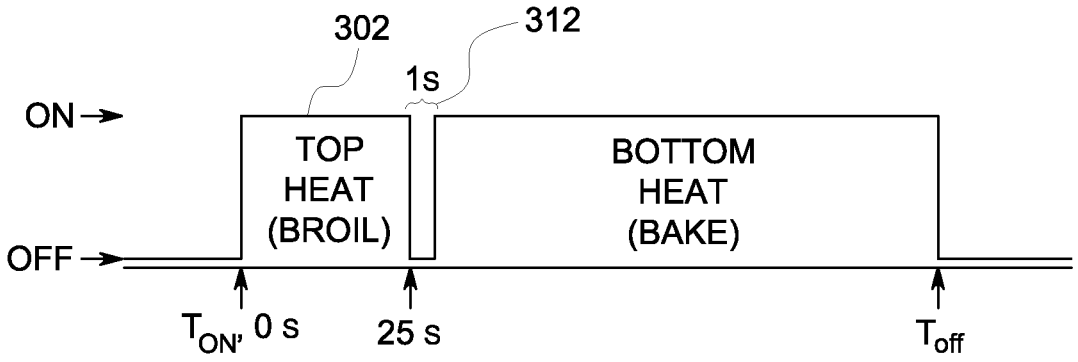
FIG. 5 is an exemplary timing diagram illustrating broil and bake cooking cycles in an appliance incorporating aspects of the disclosed embodiments.

FIG. 5 illustrates an exemplary timing diagram for a cooking cycle in an appliance 100 incorporating aspects of the disclosed embodiments. In this embodiment, the broil burner 211, which in an initial state is OFF, is activated or turned ON at time $T_{on}$, beginning the timed broil cycle. The broil burner 211 remains activated for the duration of the first predetermined time period 302, which in this example, is approximately 25 seconds. After expiration of this first predetermined time period 302, the broil burner 211 is deactivated or turned OFF, initiating a second predetermined time period 312, which in this example is approximately one (1) second. In alternate embodiments, the first and second predetermined time periods can be any suitable time period relative to the set temperature desired for the oven cavity 200. At the end of the second predetermined time period 312, the bake burner 210 is turned ON. The bake burner 210 remains ON until time $T_{off}$, which is the point at which the maximum temperature set point 404 is reached inside the oven cavity 200, or a maximum time period of time has elapsed. Normally the maximum temperature set point 404 should be reached after the bake burner 210 has been ON for approximately 100 seconds, for example. The maximum time limitation of the temperature-dependent bake cycle ensures that bake burner 210 does not continuously run in the event of a malfunction in a temperature sensing device or the bake burner itself. The time period between $T_{off}$ and the next broil cycle beginning with $T_{on}$ is dependent on the temperature inside the oven cavity 200. The timed broil cycle at $T_{on}$ begins once the minimum temperature set point 402 is reached.

In one embodiment, operation of the heat sources 210, 211 may be controlled differently depending on an operational temperature range or band of the gas oven cavity 200. In one aspect of the exemplary embodiments, operation of the heat sources 210, 211 is divided into two or more temperature ranges for baking. For example, a first temperature range corresponds to selected baking temperatures below approximately 400 degrees Fahrenheit and a second temperature range corresponds to selected baking temperatures at or above approximately 400 degrees Fahrenheit. The control unit 170 is configured such that the timed cycle of the broil burner 211 is activated and deactivated for different periods of time for each of the temperature ranges. For example, for selected baking temperatures below approximately 400 degrees Fahrenheit, such as the set temperature of 350 degrees Fahrenheit described in regards to FIG. 4, the timed ON cycle of the broil burner 211 will be approximately 30 seconds and the OFF cycle will be approximately 15 seconds. For selected baking temperatures at or above approximately 400 degrees Fahrenheit, such as a set temperature of 425 degrees Fahrenheit, the broil burner 211 is activated, for example, for approximately 40 seconds, then is deactivated for about 1 second before the temperature dependent cycle of the bake burner 210 begins.

The control unit 170 may include any suitable components for effecting the cycling of the first and second heat sources 210, 211 as is described herein. In one embodiment, the control unit 170 may include a memory 171 for storing information and data related to the execution of the processes described herein, such as for example, the cycling rate control data, minimum and maximum temperature threshold or set point data for the oven cavity 200. In one embodiment, for a particular bake set temperature, the memory may include information related to minimum and maximum temperature set points 402, 404 that are optimal for oven performance at that set temperature. In alternate embodiments, the memory 171 may also include other relevant information, such as, for example, PREHEAT temperature thresholds, or other temperature thresholds and cycle times that are optimal for varying oven settings. In one embodiment, the data stored in the memory can be specified by, for example, the manufacturer of the cooking appliance 100 (or any other suitable entity) during manufacture of the cooking appliance 100 or during service of the cooking appliance 100 in the field. The memory may include any other suitable memory, storage device or computer readable storage medium.

The control unit 170 can also include one or more processors configured to carry out the processes described herein as well as access, for example, the memory 171 for obtaining the cycling control data and for controlling the cycling and an amount of heat produced by the first heat source and/or second heat source during baking in response to inputs to the control unit 170. The processor(s) and/or memory may include, or have embodied thereon, any suitable computer readable program code for executing the processes and control of the cooking appliance 100 as described herein.

In one embodiment, the control unit 170 also includes one or more sensors 172 for monitoring and regulating the temperature inside oven cavity 200. Sensor 172 is used to relay information to the control unit 170 in order to sufficiently operate the temperature dependent features of the baking cycle.

The aspects of the disclosed embodiments provide for selectively cycling two heat sources in a gas oven by providing a timed operational cycle of the upper heat source or broil burner 211, followed by a temperature-dependent operational cycle of the lower heat source or bake burner 210. By initially adding top heat to the cooking algorithm, cooking performance can be improved by applying browning to both the top and bottom sides of the food item. Using a subsequent temperature-dependent bake burner cycle, regardless of the time that it takes the oven igniter to heat up and ignite the gas to the oven 200, the lower heat source 210 will heat the oven cavity 200 to approximately the same temperature during each temperature-dependent cycle. By heating the oven cavity 200 to approximately the same temperature during each cycle, the susceptibility of the oven cavity 200 to varying input power voltages and variations in the time needed for the oven igniter to reach the ignition temperature is diminished. This provides improved and repeatable cooking at all consumer input power supply voltages.

Thus, while there have been shown and described and pointed out fundamental novel features of the invention as applied to the exemplary embodiments thereof, it will be understood that various omission and substitutions and changes in the form and details of devices illustrated, and in their operation, may be made by those skilled in the art without departing from the spirit of the invention. For example, it is expressly intended that all combinations of those elements and/or method steps, which perform substantially the same way to achieve the same results, are with the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A gas cooking appliance comprising:

a gas oven cavity for cooking a food item, the gas oven cavity including a top surface and a bottom surface;

a lower heat source disposed adjacent the bottom surface of the gas oven cavity;

an upper heat source disposed adjacent the top surface of the gas oven cavity; and a controller configured to cycle the upper heat source and the lower heat source for providing heat above and below the food item during cooking;

wherein a cycle of the upper heat source is time-dependent; and wherein a cycle of the lower heat source is temperature-dependent.

2. The gas cooking appliance of claim 1, wherein the controller is further configured to:

activate the upper heat source for a first predetermined period of time;

activate the lower heat source at an end of a second predetermined period of time; and deactivate the lower heat source when a maximum temperature set point is reached.

3. The gas cooking appliance of claim 2, wherein the controller is further configured to activate the upper heat source when a minimum temperature set point is reached.

4. The gas cooking appliance of claim 1, wherein at least one of the lower heat source and the upper heat source comprises a gas burner.

5. The gas cooking appliance of claim 1, further comprising a sensor for monitoring an internal temperature of the gas oven cavity.

6. The gas cooking appliance of claim 1, wherein the controller is further configured to cycle the upper heat source such that the upper heat source is activated for a first predetermined period of time.

7. The gas cooking appliance of claim 6, wherein the controller is further configured to cycle the lower heat source such that the lower heat source is activated upon expiration of a second predetermined period of time measured from the expiration of said first predetermined period of time and remains activated until a maximum temperature set point has been reached inside the gas oven cavity.

8. The gas cooking appliance of claim 1, wherein the controller is further configured to activate the time-dependent cycle of the upper heat source when the temperature inside the gas oven cavity falls below a minimum temperature threshold.

9. The gas cooking appliance of claim 1, wherein the controller is further configured, during the cooking, to:

activate the upper heat source for a first predetermined period of time;

deactivate the upper heat source at an end of the first predetermined period of time; and activate the lower heat source after the upper heat source is deactivated for a second predetermined period of time.

10. The gas cooking appliance of claim 9, wherein the controller is further configured to detect that the temperature inside the gas oven cavity is below a minimum temperature threshold after the lower heat source is deactivated and then repeat the steps of:

activating the upper heat source for the first pre-determined time period;

deactivating the upper heat source at the end of the first predetermined period of time; and activating the lower heat source after the upper heat source is deactivated for the second predetermined period of time.

11. A method of controlling a cooking cycle in a gas cooking appliance comprising a lower heat source disposed adjacent to a bottom surface of a gas oven cavity for providing heat below a food item and an upper heat source disposed adjacent to a top surface of the gas oven cavity for providing heat above the food item, the method comprising;

activating the upper heat source for a first predetermined period of time;

activating the lower heat source at an end of a second predetermined period of time measured from the end of said first predetermined period of time; and deactivating the lower heat source when a temperature within the gas oven cavity reaches a maximum temperature set point.

12. The method of claim 11, further comprising activating the upper heat source when the temperature within the gas oven cavity falls below a minimum temperature set point.

13. The method of claim 11, wherein the first predetermined time period is longer than the second predetermined time period.

14. The method of claim 11, wherein the lower and upper heat sources each comprise a gas burner.

15. The method of claim 14, wherein the upper heat source is a broil burner and the lower heat source is a bake burner.

16. The method of claim 11, further comprising:

detecting an activation of a bake cooking cycle; and activating the upper heat source for the first predetermined time period.

17. The method of claim 16, wherein the first predetermined time period is dependent upon a temperature set point for the gas oven cavity.

18. The method of claim 16, wherein the upper heat source is activated after a preheat portion of the bake cooking cycle.

19. The method of claim 11, wherein the method further comprises, during a food cooking cycle:

deactivating the upper heat source at the end of the first predetermined time period and activating the lower heat source only after the upper heat source has been deactivated for the second predetermined period of time.

20. The method of claim 19, wherein the method further comprises, during the food cooking cycle:

detecting that the temperature inside the gas oven cavity is below a minimum temperature threshold after the lower heat source is deactivated and then repeat the steps of:

activating the upper heat source for the first pre-determined time period;

deactivating the upper heat source at the end of the first predetermined period of time; and activating the lower heat source after the upper heat source is deactivated for the second predetermined period of time.

* * * * *